US005528223A

United States Patent [19]

DiLonardo et al.

[11] Patent Number: 5,528,223

[45] Date of Patent: Jun. 18, 1996

[54] VIDEO GAME CARTRIDGE INCLUDING A SECURITY DEVICE AND METHOD OF DETERRING THEFT OF SAME

[75] Inventors: Robert L. DiLonardo, Clearwater; Douglas A. Narlow, Coral Springs, both of Fla.

[73] Assignee: Sensormatic Electronics Corporation, Deerfield Beach, Fla.

[21] Appl. No.: 312,632

[22] Filed: Sep. 27, 1994

[51] Int. Cl.[6] ..... G08B 23/00

[52] U.S. Cl. ..... 340/572; 340/571; 340/551

[58] Field of Search ..... 340/572, 571, 340/551; 324/260; 335/151, 156, 153; 345/133; 360/69; 273/85 G

[56] References Cited

U.S. PATENT DOCUMENTS

| | | | |
|---|---|---|---|
| Re. 34,161 | 1/1993 | Nakagawa et al. | 273/85 |
| 3,747,086 | 7/1973 | Peterson | 340/280 |
| 4,063,229 | 12/1977 | Welsh | 340/572 |
| 4,151,405 | 4/1979 | Peterson | 235/382 |
| 4,510,489 | 4/1985 | Anderson, III et al. | 340/572 |
| 4,794,470 | 12/1988 | Lauffenburger et al. | 360/69 |
| 4,862,156 | 8/1989 | Westberg et al. | 340/747 |
| 4,905,280 | 2/1990 | Wiedemer | 380/16 |
| 4,959,861 | 9/1990 | Howlette | 380/4 |
| 4,981,300 | 1/1991 | Winkler | 273/238 |
| 5,004,232 | 4/1991 | Wong et al. | 273/435 |
| 5,155,768 | 10/1992 | Matsuhara | 380/23 |

*Primary Examiner*—John K. Peng
*Assistant Examiner*—Albert K. Wong
*Attorney, Agent, or Firm*—Robin, Blecker, Daley & Driscoll

[57] ABSTRACT

A video game cartridge includes a memory and a security device, which comprises a magnetically operated switch and a magnetic element positioned adjacent to the switch. The switch has first and second states with the first state for inhibiting the functioning of the memory of the cartridge and the second state for permitting the functioning of the memory of the cartridge. The magnetic element has a first magnetic state for placing the switch in the first state and a second magnetic state for placing the switch in the second state.

26 Claims, 4 Drawing Sheets

VIDEO GAME CARTRIDGE INCLUDING A SECURITY DEVICE AND METHOD OF DETERRING THEFT OF SAME

BACKGROUND OF THE INVENTION

This invention relates to the deterrence from theft of electrical devices and particularly to a video game cartridge including a security device to deter theft of the cartridge by preventing the cartridge from functioning thereby denying the thief the ability to use the cartridge.

Over the past several years, computer games have become an increasingly popular form of entertainment. Typically, a video game player is connected to a television set. The user then selects a desired video game by choosing the corresponding video game cartridge and inserting the cartridge into the video game player. Each video game cartridge contains video game software in the form of a read only memory ("ROM") which permits the game software to be read from the cartridge. With the cartridge inserted in the player, the game player then reads the game software and runs the video game. The user then responds to the game being displayed on the television set by moving a joystick or pushing buttons.

Individual game cartridges used to play the computer games, however, are expensive, which result in increased theft of the cartridges. Accordingly, retailers often have to secure the cartridges in locked display cases. While such precautions minimize theft, such lack of open merchandising decreases the overall sales volume of the video game cartridges.

Although various types of security apparatuses have been developed for video game cartridges, such apparatuses generally determine whether the video game cartridge inserted into the video game player is an authentic or counterfeit cartridge. Such security apparatuses, however, do not deter theft of the cartridges from a retail establishment. Accordingly, new apparatuses and methods are being sought to inhibit the functioning of the cartridge if improperly removed from a retail establishment as well as to allow open merchandising of the cartridge.

It is therefore an object of the present invention to provide a video game cartridge which includes a security device that in one state permits the functioning of the video game cartridge and in another state inhibits the functioning of the video game cartridge.

It is an additional object of the present invention to provide a video game cartridge including a security device which allows for open display of the video game cartridge by a retail establishment based upon its configuration.

It is a further object of the present invention to provide a video game cartridge including a security device, which is simple in structure and economical to manufacture.

SUMMARY OF THE INVENTION

In accordance with the principles of the present invention, the above and other objectives are realized by a video game cartridge including a security device. The security device includes a magnetically operated switch having first and second states and a magnetic element positioned adjacent to the switch The first state of the switch inhibits the functioning of the memory of the cartridge and the second state of the switch permits the functioning of the memory of the cartridge. The magnetic element positioned adjacent to the switch includes a first magnetic state to place the switch in the first state and second magnetic state to place the switch in the second state.

In an additional embodiment, a video game player includes a security device, which permits and inhibits the functioning of the player to deter theft of the player by denying the thief the ability to use the player.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
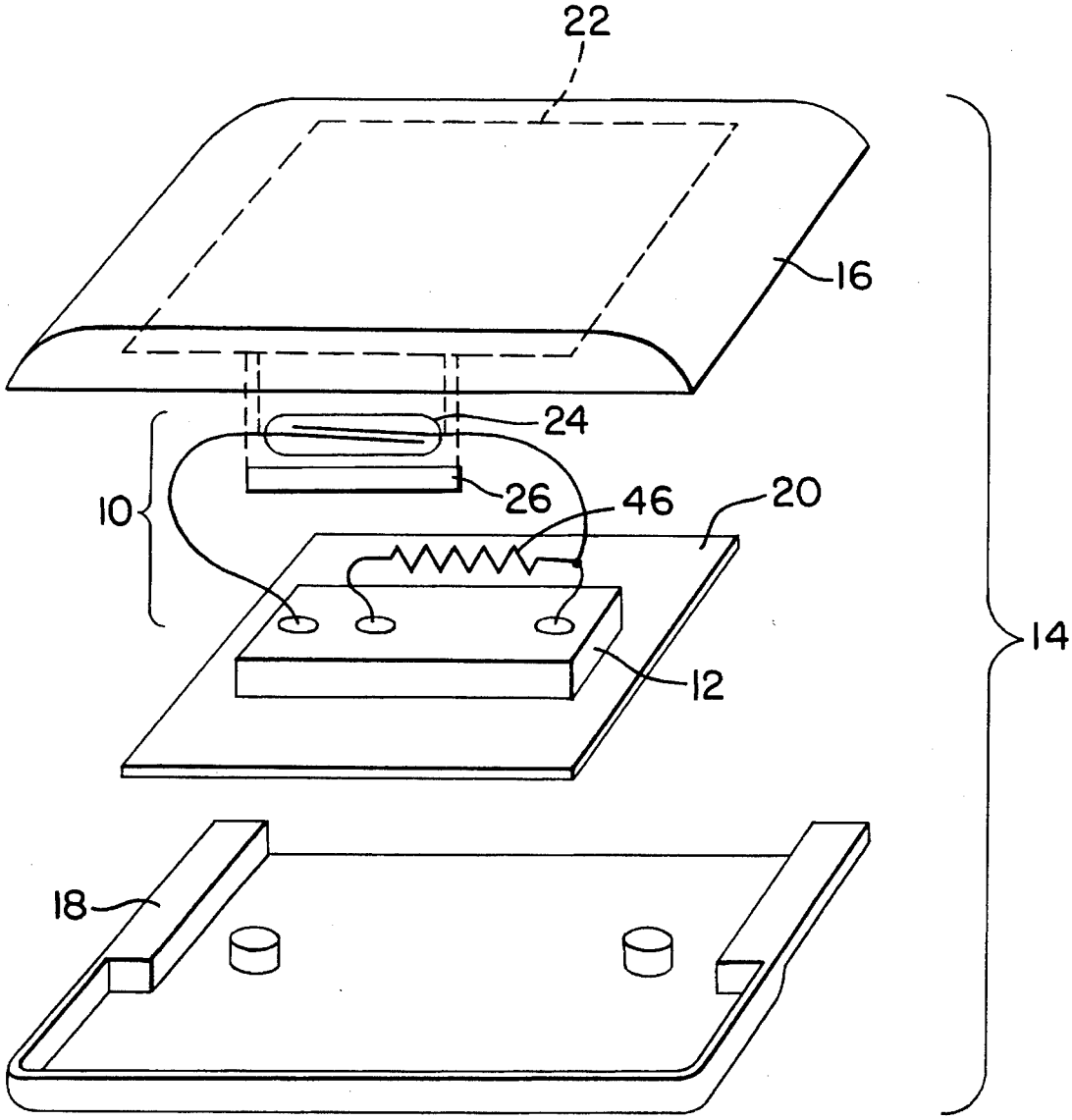
FIG. 1 shows an exploded view of a video game cartridge including a security device in accordance with the present invention.
Figure 2:
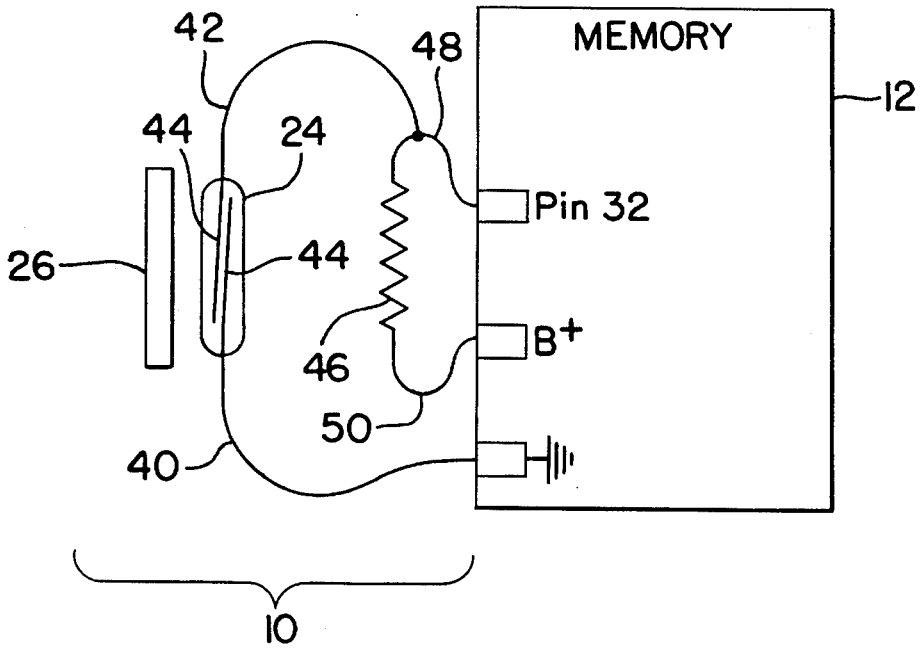
FIG. 2 shows a view of the security device attached to a memory of the video game cartridge of FIG. 1.

A video game cartridge 14 of the present invention includes a security device 10, as illustrated in FIGS. 1 and 2, which permits or inhibits the functioning of a memory 12 of a video game cartridge 14. Such control of the functioning of the cartridge 14 helps to deter theft by denying the thief the ability to use the cartridge 14 unless the security device 10 is in a state that permits the cartridge 14 to function.

As shown in the exploded view of FIG. 1, the video game cartridge 14 has top and bottom covers 16 and 18, a circuit board 20 sandwiched therein and a memory 12 attached to the circuit board 20. The security device 10 may comprise any magnetically operated switch and a magnetizable element positioned adjacent thereto in a manner to permit the switch to open or close depending upon whether the magnetizable element is magnetized or demagnetized. In the preferred embodiment, the security device 10 is a reed switch 24, connected in circuit with the memory 12 of the cartridge 14, and a semi-hard magnetic element 26 positioned adjacent and parallel to the reed switch 24. The reed switch 24 comprises two contacts 44 mounted on ferromagnetic reeds sealed in a glass tube and is designed for actuation by an external magnetic field. The contacts 44 have first and second states or open and closed positions depending upon the presence or absence of a magnetic field. The magnetic element 26 provides the needed external magnetic field for opening and closing the contacts 44 of the reed switch 24. The reed switch 24 and the magnetic element 26 may then be attached as shown by dashed lines in FIG. 1 to the upper inside portion 22 of the top cover 16 of the cartridge 14 and adjacent to the circuit board 20.

In order for the security device 10 to permit or inhibit the functioning of the memory 12, the magnetic element 26 has first and second magnetic states or magnetized and demagnetized states. The magnetic element 26 may be magnetized and demagnetized by a variety of devices and methods. For example, a permanent hard magnet having a high DC field, such as a samarium cobalt magnet (not shown), may be passed along the length of the element 26 to magnetize the magnetic element 26.

Figure 4:
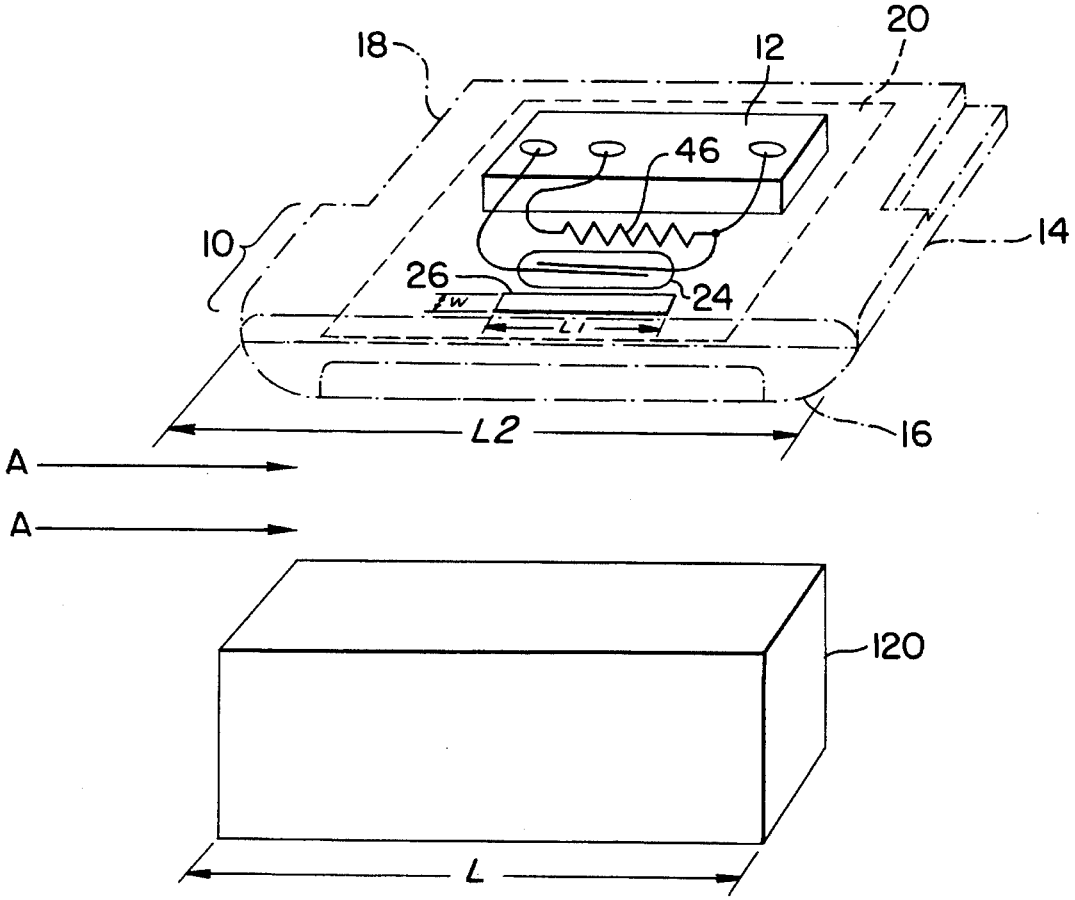
FIG. 4 shows a view of a deactivator positioned to deactivate a magnetic element of the security device in the video game cartridge of FIG. 1.

To demagnetize the magnetic element 26, a deactivator, such as a tape head degausser 120, as illustrated in FIG. 4, may be used. As illustrated, the security device 10 is positioned in the cartridge 14 so that the magnetic element 26 of the security device 10 can be demagnetized along its long axis to activate the reed switch 24. To accomplish this, the degausser 120 with its alternating AC field is positioned adjacent to the top cover 16 of the cartridge 14. Such positioning results in the length L of the degausser 120 being parallel to the length L1 of the magnetic element 26 and being sufficient in length to span the length L1 of the magnetic element 26.

The degausser 120 is then held stationary, and the cartridge 14 including the security device 10 is moved across the degausser 120 in a sweeping manner as indicated by lines A. This motion causes the magnetic element 26 to be demagnetized along its length L1 thereby opening the contacts 44 of the reed switch 24 to allow the memory 12 of the cartridge 14 to function normally. Alternatively, the cartridge 14 can be held stationary, and the degausser 120 may be swept across the length L2 of the cartridge 14. This motion also causes the magnetic element 26 of the security device 10 to be demagnetized along its length L1. Such motion to demagnetize the magnetic element 26 by the tape head degausser 120, respectively, can occur in either direction, i.e., right to left, left to right.

Depending upon the magnetic state of the magnetic element 26, the security device 10 of the video cartridge 14 can operate as follows: when the magnetic element 26 is magnetized, for example, by the samarium cobalt magnet, the contacts 44 of the reed switch 24 are closed. Since the reed switch 24 is in circuit with the memory 12 of the cartridge 14, the closed contacts 44 of the reed switch 24 inhibit the functioning of the memory 12 thereby preventing video game operation. If, however, the magnetic element 26 is demagnetized by the tape head degausser 120 (see FIG. 4), then the contacts 44 of the reed switch 24 are open. This permits the memory 12 to function and the cartridge 14 can now operate normally. The reed switch 24 can also function in the reverse manner by being open when the magnetic element 26 is magnetized and being closed when the element 26 is demagnetized. One skilled in the art can easily connect the magnetic switch 24 into the memory circuit in such a manner that the memory 12 would be disabled either by arranging for the switch contacts 44 to be closed or open.

FIG. 2 illustrates a particular embodiment of the security device 10 connected in circuit with the memory 12 of the video game cartridge 14 which is manufactured by SEGA Enterprises, Ltd., Tokyo, Japan. The memory 12 of the cartridge 14 comprises a TC5316210BP/BF/BFT 16M bit CMOS (complementary metal-oxide silicon) Mask ROM Toshiba MOS Integrated circuit. The memory 12 of the cartridge 14, as illustrated in modified form in FIG. 2, is a Read Only Memory ("ROM") organized as 1,048,576 words by 16 bits when pin 32 ($\overline{\text{BYTE}}$—word, byte selection input on the circuit) is logical high and as 2,097,152 words by 8 bits when pin 32 ($\overline{\text{BYTE}}$) is logical low. A first lead 40 of the reed switch 24 is connected to a ground of the memory 12. A second lead 42 is connected to a first lead 48 of a resistor 46, preferably 3.3 kOhm, which is connected to pin 32 ($\overline{\text{BYTE}}$) of the memory 12. The second lead 50 of the resistor 46 is connected to $B^+$ of the memory 12. By connecting the reed switch 24 in such a manner to the memory 12, the reed switch 24 permits or inhibits the functioning of the cartridge 14.

For example, if the magnetic element 26 has been magnetized resulting in the contacts 44 of the switch 24 being closed, the connection of the reed switch 24 to the memory 12 grounds the pin 32 ($\overline{\text{BYTE}}$) to logical low and organizes the memory 12 as 2,097,152 words by 8 bits. This inhibits the cartridge 14 from functioning in the video game player 30 because the player 30 is looking for normal operation of the memory 12 as logical high (16 bits) and not as logical low (8 bits). If the magnetic element 26 is demagnetized, thus opening the contacts 44 of the switch 24, the pin 32 ($\overline{\text{BYTE}}$) is then again logical high (16 bits) thereby allowing the cartridge 14 to operate normally. The security device 10, however, is not limited to the above, but can be connected in circuit to the cartridge 14 in a variety of ways to permit and inhibit its functioning. For example, the reed switch 24 can also be connected in circuit with any of the interface lines between the cartridge 14 and the video game player 30 to permit and inhibit operation.

A security device 10 meeting the above criteria for permitting and inhibiting the functioning of the cartridge 14 has been fabricated using a reed switch 24 requiring approximately 50 Gauss to operate. The magnetic element 26 may be a magnetic steel cylindrical pin having a dowel shape and a coercivity of approximately 50 Oersteds, and a length of 1" and a diameter of 0.125". Other useful lengths and diameters may be 0.185"×0.75"; 0.185"×1"; and 0.185"×0.5".

Figure 5:
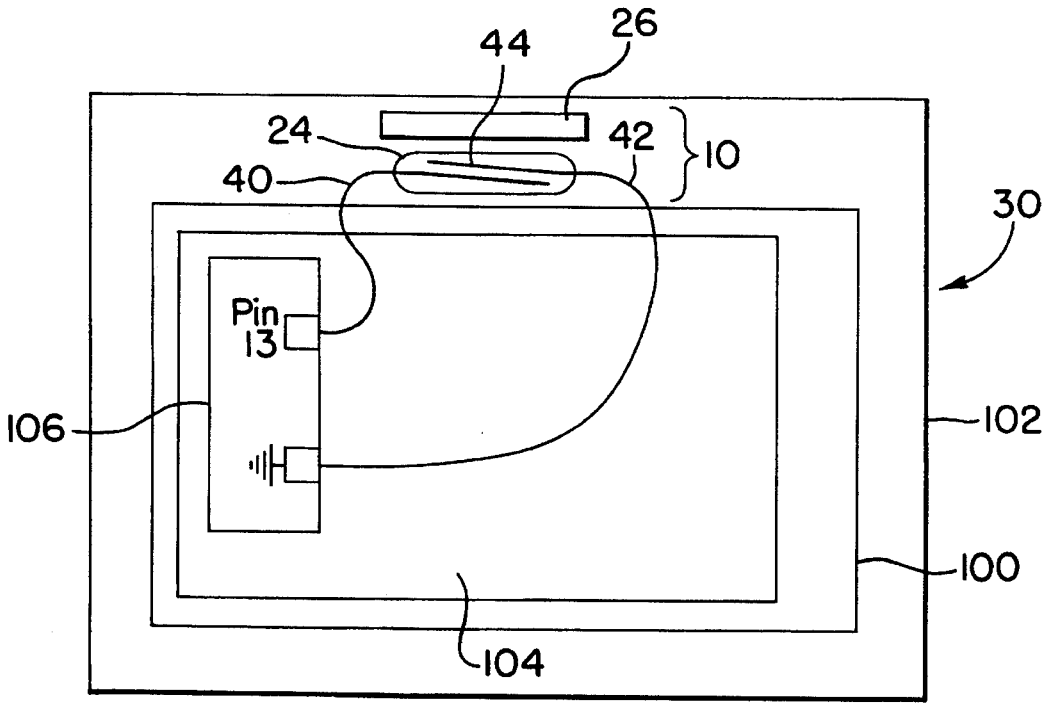
FIG. 5 shows a simplified representation of a video game player including a security device in accordance with the present invention.

The security device 10 can also be incorporated in a video game player 30 to deter theft as illustrated in FIG. 5. Similar to the video game cartridge 14, the security device 10 is incorporated in the video game player 30 to permit or inhibit the functioning of the player 30. As shown in FIG. 5, the security device 10 may be attached to the outside of the tin plated steel shield 100 within a plastic enclosure 102 of the video game player 30. The security device 10 incorporated in the player 30 can then be used to activate or deactivate the microprocessor 106 in operating means 104 of the player 30. The microprocessor 106 used in the player 30 may, for example, comprise a Motorola MC 68000 chip. One lead 40 of the reed switch 24 is connected to pin 13 ($\overline{\text{BR}}$—Bus Request) of the microprocessor 106 and a second lead 42 of the reed switch 24 is connected to ground.

For example, the pin 13 ($\overline{\text{BR}}$) on the microprocessor 106 is at logical high for normal operation having a pull-up resistor on board of a value 2.2 kOhm. When the magnetic element 26 is magnetized, the reed switch 24 can be closed, resulting in the connection to the pin 13 ($\overline{\text{BR}}$) being grounded, thereby disabling the functioning of the player 30. When the magnetic element 26 is demagnetized, the reed switch 24 opens to allow the pin 13 ($\overline{\text{BR}}$) to be at logical high and permit the player 30 to function normally.

Theft of the cartridge 14 or player 30 would be deterred by placing signs in appropriate locations advising that the cartridge 14 or player 30 on the shelves are in an inoperative condition and will be placed in an operative condition at the cashier's station or checkout area before leaving the store. Then when the customer selects the article and presents it to the cashier, the cashier takes payment and activates or deactivates the switch 24 with a magnet or degausser, as the case may be, to permit the cartridge 14 or player 30 thereafter to function in a normal manner.

Figure 3:
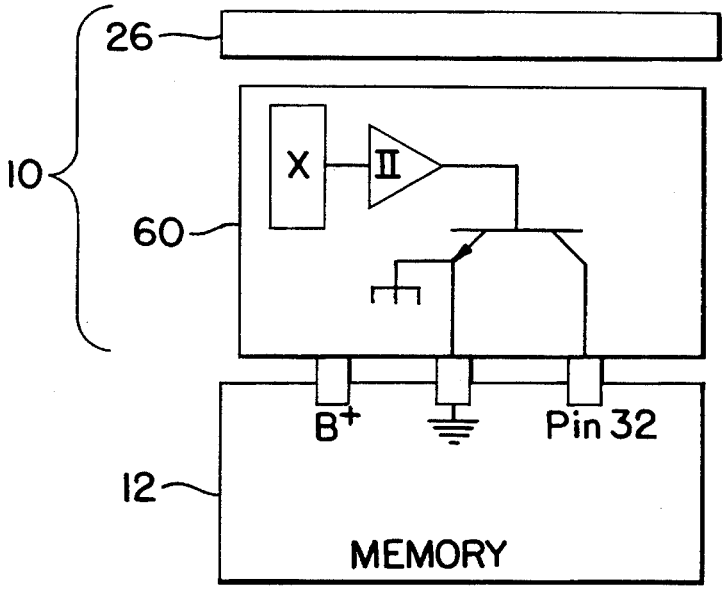
FIG. 3 shows a view of a modified embodiment of the security device attached to the memory of the video game cartridge of FIG. 1.

A variety of different types of switches may be used in the security device 10 which are mechanical, electrical or a combination of both. For example, as illustrated in FIG. 3, a Hall effect device 60 may be substituted for the reed switch 24 to control the operation of the cartridge 14. As illustrated in FIG. 3, the Hall effect device 60, similar in operation to a switch, operates in connection with the magnetized and demagnetized states of the magnetic element 26. A first lead 62 is connected to a ground of the memory 12. A second lead 64 is connected to the lead 48 of the resistor 46, which is connected to pin 32 ($\overline{\text{BYTE}}$) Of the memory 12 to permit or inhibit the functioning of the cartridge 14. The Hall effect device 60 used in the security device 10 of the present invention may, for example, comprise a UGN3175U circuit made by Sprague Technologies, Inc.

In another embodiment, the security device 10 may be combined with a theft deterrent electronic article surveillance ("EAS") marker which employs a semi-hard magnetic element to deactivate an active element and is usually attached to merchandise to prevent unauthorized removal of the merchandise from a store. The EAS marker may be of the radio frequency or microwave type. The marker may also be of the magnetic type which operates in harmonic systems or it may be of the magnetomechanical type such as that sold under the trademark, ULTRAMAX and disclosed in U.S. Pat. No. 4,510,489. In both the magnetic and magnetomechanical cases, in addition to the active element of the marker, a semi-hard magnetic element is also disposed adjacent to the active element. Thus, by positioning the EAS marker adjacent to the reed switch 24, the EAS marker can perform two functions. First, the EAS marker may function normally as a device to be detected by an EAS system if the article of merchandise to which the marker is attached is attempted to be stolen. Second, the marker, with its semi-hard magnetic element, may also act as the magnetic element 26 described above, to place the reed switch 24 in a first or second state. An EAS deactivator at a check-out area can then be used not only to deactivate the EAS marker so that the EAS system is not triggered when an authorized person, such as a purchaser, leaves the store with the cartridge 14 or video player 30 but also to deactivate the security device 10 to permit the functioning of the cartridge 14 or player 30.

The security device 10 is illustrated as being attached to the top cover 16 of the cartridge 14. However, the security device 10 is not limited to such placement and can be attached or incorporated in a variety of positions on or in the cartridge 14. The magnetic element 26 may also be any shape or configuration or in any position which allows for the opening and closing of the reed switch 24 to permit or inhibit the functioning of the cartridge 14 or player 30. The cartridge and player are also not limited to the presently illustrated embodiments but may include a variety of different types of video game cartridges or players made by various manufacturers, such as SEGA Enterprises, Ltd., Tokyo, Japan or Nintendo Co., Ltd., Kyoto, Japan.

The security device 10 may also be used in various types of electrical products or apparatuses, other than the specific apparatuses mentioned above, to help deter theft of the apparatus by preventing the apparatus from functioning if improperly removed from the retail establishment.

In all cases it is understood that the above-described configurations are merely illustrative of the many possible specific embodiments which represent applications of the present invention. Numerous and varied other configurations, can be readily devised in accordance with the principles of the present invention without departing from the spirit and scope of the invention.

What is claimed is:

1. A video game cartridge including:

a memory; and a security device comprising:

a magnetically operated switch having first and second states connected to said memory of said cartridge, said first state of the switch for inhibiting the functioning of the memory of the cartridge and the second state of the switch for permitting the functioning of the memory of the cartridge; and a magnetic element positioned adjacent to said switch, said magnetic element having a first magnetic state for placing the switch in the first state and a second magnetic state for placing the switch in the second state.

2. A video game cartridge in accordance with claim 1, wherein:

said magnetic element is in said first magnetic state when said element is magnetized and is in said second magnetic state when said element is demagnetized.

3. A video game cartridge in accordance with claim 2, wherein:

said switch includes contacts which are closed when said switch is in the first state and the magnetic element is magnetized and said contacts are open when said switch is in the second state and the magnetic element is demagnetized.

4. A video game cartridge in accordance with claim 3, further comprising:

resistor means connected to said memory to keep an input to said memory at logical high when said contacts are in said open position.

5. A video game cartridge in accordance with claim 1, wherein:

said switch is a reed switch.

6. A video game cartridge in accordance with claim 5, wherein:

said magnetic element is comprised of a semi-hard magnetic material.

7. A video game cartridge in accordance with claim 1, wherein:

said switch is a Hall effect device.

8. A video game cartridge in accordance with claim 1, wherein:

said magnetic element is a semi-hard magnetic element of a marker, said marker for use in an electronic article surveillance system being secured to said video game cartridge to enable detection by the electronic article surveillance system of the cartridge and for activating and deactivating the security device.

9. A video game player including:

operating means; and a security device comprising:

a magnetically operated switch having first and second states connected to said operating means of said player, said first state of the switch for inhibiting the functioning of the operating means of the player and the second state of the switch for permitting the functioning of the operating means of the player; and a magnetic element positioned adjacent to said switch, said magnetic element having a first magnetic state for placing the switch in the first state and a second magnetic state for placing the switch in the second state.

10. A video game player in accordance with claim 9, wherein:

said magnetic element is in said first magnetic state when said element is magnetized and is in said second magnetic state when said element is demagnetized.

11. A video game player in accordance with claim 10, wherein:

said switch includes contacts which are closed when said switch is in the first state and the magnetic element is magnetized and said contacts are open when said switch is in the second state and the magnetic element is demagnetized.

12. A video game player in accordance with claim 11, further comprising:

resistor means connected to said operating means to keep an input to said operating means at logical high when said contacts are in said open position.

13. A video game player in accordance with claim 9, wherein:

said switch is a reed switch.

14. A video game player in accordance with claim 13, wherein:

said magnetic element is comprised of a semi-hard magnetic material.

15. A video game player in accordance with claim 9, wherein:

said switch is a Hall effect device.

16. A video game player in accordance with claim 9, wherein:

said magnetic element is a semi-hard magnetic element of a marker, said marker for use in an electronic article surveillance system being secured to said video game player to enable detection by an electronic article surveillance system of the player and for activating and deactivating the security device.

17. A method for permitting or inhibiting the functioning of a video game cartridge including a memory and a security device, comprising the steps of:

providing and positioning said security device in said cartridge, said security device comprising a magnetically operated switch connected to the memory of the cartridge and a magnetic element positioned adjacent to said switch, said switch having a first state for inhibiting the functioning of the memory of the cartridge and a second state for permitting the functioning of the memory of the cartridge and said magnetic element having first and second magnetic states; and placing said magnetic element in said first or second magnetic state so that when said magnetic element is in said first magnetic state, said switch is placed in the first state thereby inhibiting the functioning of the memory and when said magnetic element is in said second magnetic state, said switch is placed in the second state thereby permitting the functioning of the memory.

18. A method in accordance with claim 17, wherein:

said switch in said first state is closed when said magnetic element in said first magnetic state is magnetized thereby inhibiting the functioning of the memory and said switch in said second state is open when said magnetic element in said second magnetic state is demagnetized thereby permitting the functioning of the memory.

19. A method in accordance with claim 18, said method further comprises:

providing resistor means connected to the memory of the cartridge to keep an input to the memory at logical high when the switch is open.

20. A method in accordance with claim 17, wherein:

said switch is a reed switch.

21. A method in accordance with claim 17, wherein:

said magnetic element is a semi-hard magnetic element of a marker, said marker for use in an electronic article surveillance system being secured to said video game cartridge to enable detection by an electronic article surveillance system of the cartridge and for activating and deactivating the security device.

22. A method in accordance with claim 17, wherein:

said switch is a Hall effect device.

23. A method for permitting or inhibiting the functioning of a video game player including operating means and a security device, comprising the steps of:

providing and positioning said security device in said player, said security device comprising a magnetically operated switch connected to the operating means of the player and a magnetic element positioned adjacent to said switch, said switch having a first state for inhibiting the functioning of the operating means of the player and a second state for permitting the functioning of the operating means of the player and said magnetic element having first and second magnetic states; and placing said magnetic element in said first or second magnetic state so that when said magnetic element is in said first magnetic state, said switch is placed in the first state thereby inhibiting the functioning of the operating means of the player and when said magnetic element is in said second magnetic state, said switch is placed in the second state thereby permitting the functioning of the operating means of the player.

24. A method in accordance with claim 23, wherein:

said switch in said first state is closed when said magnetic element in said first magnetic state is magnetized thereby inhibiting the functioning of the operating means and said switch in said second state is open when said magnetic element in said second magnetic state is demagnetized thereby permitting the functioning of the operating means.

25. A method in accordance with claim 23, wherein:

said switch is a reed switch.

26. A method in accordance with claim 23, wherein:

said switch is a Hall effect device.

* * * * *